US009469470B2

(12) United States Patent
Stahl

(10) Patent No.: US 9,469,470 B2
(45) Date of Patent: Oct. 18, 2016

(54) THREE TIERED TRAY

(75) Inventor: Edward L. Stahl, Tyler, TX (US)

(73) Assignee: ORBIS Corporation, Oconomowoc, WI (US)

( * ) Notice: Subject to any disclaimer, the term of this patent is extended or adjusted under 35 U.S.C. 154(b) by 346 days.

(21) Appl. No.: 13/424,495

(22) Filed: Mar. 20, 2012

(65) Prior Publication Data

US 2012/0241350 A1 Sep. 27, 2012

Related U.S. Application Data

(60) Provisional application No. 61/467,213, filed on Mar. 24, 2011.

(51) Int. Cl.

| | |
|---|---|
| ***B65D 21/00*** | (2006.01) |
| ***B65D 85/36*** | (2006.01) |
| ***B65D 21/02*** | (2006.01) |
| ***B65D 21/04*** | (2006.01) |

(52) U.S. Cl.

CPC ..... *B65D 85/36* (2013.01); *B65D 21/0212* (2013.01); *B65D 21/046* (2013.01)

(58) Field of Classification Search

CPC ..... B65D 21/0213; B65D 21/0224; B65D 85/36; B65D 21/0212; B65D 21/046

USPC ..... 206/518, 519, 503, 509, 511, 515, 505, 206/507, 516, 203, 557, 512, 520

See application file for complete search history.

(56) References Cited

U.S. PATENT DOCUMENTS

| | | | | |
|---|---|---|---|---|
| 2,026,204 A | | 12/1935 | Andrews | |
| 2,029,746 A | | 2/1936 | Tufts et al. | |
| 2,061,414 A | | 11/1936 | Tufts et al. | |
| 2,457,841 A | | 1/1949 | Smith et al. | |
| 2,457,842 A | | 1/1949 | Smith et al. | |
| 2,641,383 A | | 6/1953 | Coursey | |
| 2,852,157 A | * | 9/1958 | Frater | B65D 21/043 206/507 |
| 3,149,748 A | | 9/1964 | Hare et al. | |
| 3,375,953 A | | 4/1968 | Miller, Jr. | |
| 3,379,339 A | | 4/1968 | Asenbauer | |
| 3,387,740 A | | 6/1968 | Bockenstette | |
| 3,392,875 A | | 7/1968 | Bockenstette | |
| 3,398,840 A | | 8/1968 | Wilson | |
| 3,404,804 A | | 10/1968 | Frater et al. | |
| 3,405,810 A | | 10/1968 | Rogus | |
| 3,420,402 A | | 1/1969 | Frater et al. | |

(Continued)

FOREIGN PATENT DOCUMENTS

| | | |
|---|---|---|
| CA | 2387491 A1 | 5/2001 |
| FR | 2678585 A1 | 1/1993 |

(Continued)

OTHER PUBLICATIONS

Written Opinion of International Searching Authority for PCT/US12/29918 mailed Jun. 19, 2012 (5 pages).

(Continued)

*Primary Examiner* — Jacob K Ackun
*Assistant Examiner* — Jenine Pagan
(74) *Attorney, Agent, or Firm* — Nixon Peabody LLP

(57) ABSTRACT

A highly efficient bakery tray is provided. The tray includes a square base and is configured to stack upon another like tray in any of three or four orientations to provide three or four different product clearance heights between the trays.

14 Claims, 10 Drawing Sheets

(56) References Cited

U.S. PATENT DOCUMENTS 3,421,656 A 1/1969 Asenbauer
3,480,178 A 11/1969 Morgan
3,552,598 A 1/1971 Wilson
3,570,697 A 3/1971 Langston
3,613,943 A 10/1971 Bridenstine
3,659,743 A 5/1972 Box
3,675,815 A 7/1972 Rehrig
3,752,352 A 8/1973 Senecal
3,780,905 A 12/1973 Herolzer
3,819,044 A 6/1974 Bockenstette
3,865,239 A 2/1975 Herolzer et al.
3,870,151 A 3/1975 Johnson
3,887,073 A 6/1975 Wilson
D236,168 S 7/1975 Johnson
3,907,111 A 9/1975 Levenhagen
3,917,108 A 11/1975 Thurman
3,934,724 A 1/1976 Johnson
3,937,327 A * 2/1976 Carroll ..... 206/507
3,951,265 A 4/1976 Carroll
3,952,903 A 4/1976 Sanders et al.
3,993,211 A 11/1976 Astle
4,000,817 A 1/1977 Sanders et al.
4,007,839 A 2/1977 Stahl
4,023,680 A 5/1977 Thurman
4,093,070 A 6/1978 Stahl
4,093,071 A 6/1978 Stahl et al.
4,102,453 A 7/1978 Carroll et al.
4,105,117 A 8/1978 Atkin et al.
4,106,623 A 8/1978 Carroll et al.
4,106,624 A 8/1978 Thurman
4,106,625 A 8/1978 Carroll et al.
4,109,791 A 8/1978 Clipson et al.
4,189,052 A 2/1980 Carroll et al.
4,194,626 A 3/1980 Boller
4,211,327 A 7/1980 Stahl et al.
4,238,032 A 12/1980 Thurman
D258,050 S 1/1981 Cornou
4,247,004 A 1/1981 Bird
D261,069 S 9/1981 Munch et al.
4,308,954 A 1/1982 Wilson
4,316,154 A 2/1982 Krause
4,320,837 A 3/1982 Carroll et al.
D264,513 S 5/1982 Miller
4,334,616 A * 6/1982 Wilson ..... 206/505
4,383,611 A 5/1983 Kreeger
4,391,369 A 7/1983 Stahl et al.
4,402,408 A 9/1983 Kreeger et al.
4,423,813 A 1/1984 Kreeger et al.
4,426,001 A 1/1984 Stahl et al.
4,440,302 A 4/1984 Ehrman et al.
4,441,615 A 4/1984 Goodrich
4,457,433 A 7/1984 Wilson
4,466,541 A 8/1984 Tabler et al.
4,480,748 A 11/1984 Wind
4,519,503 A 5/1985 Wilson
4,520,928 A 6/1985 Wilson
4,523,681 A 6/1985 Kreeger
4,570,798 A 2/1986 Wilson
4,573,577 A 3/1986 Miller
4,577,759 A 3/1986 Kreeger
4,600,103 A 7/1986 Tabler
4,601,393 A 7/1986 Veenman et al.
RE32,223 E 8/1986 Kreeger et al.
4,619,366 A 10/1986 Kreeger
4,619,371 A 10/1986 Rehrig
4,643,310 A 2/1987 Deaton et al.
4,671,411 A 6/1987 Rehrig et al.
D292,634 S 11/1987 Chabot
4,714,169 A 12/1987 Keenan et al.
4,720,013 A 1/1988 Nichols et al.
4,759,451 A 7/1988 Apps
4,770,300 A 9/1988 Klein
4,823,955 A 4/1989 Apps
4,842,142 A 6/1989 Kreeger
4,848,578 A 7/1989 Schafer
4,905,833 A 3/1990 Kreeger et al.
4,917,255 A 4/1990 Foy et al.
4,936,458 A 6/1990 Tabler et al.
4,960,207 A 10/1990 Tabler et al.
4,982,844 A 1/1991 Madan et al.
5,035,326 A 7/1991 Stahl
D319,908 S 9/1991 Stahl
D320,298 S 9/1991 Apps et al.
5,163,587 A 11/1992 Apps et al.
D343,042 S 1/1994 Apps et al.
D344,387 S 2/1994 Holliday
5,287,966 A 2/1994 Stahl
D348,138 S 6/1994 Lang-Ree et al.
D348,342 S 6/1994 Lang-Ree et al.
D348,343 S 6/1994 Lang-Ree et al.
D350,028 S 8/1994 Apps
D350,437 S 9/1994 Apps et al.
5,344,021 A 9/1994 Rose
5,344,022 A 9/1994 Stahl
5,372,257 A 12/1994 Beauchamp et al.
D354,167 S 1/1995 Stahl
5,377,858 A 1/1995 Morris, Sr.
5,415,293 A 5/1995 Ackermann et al.
5,469,986 A 11/1995 Jang
5,494,163 A 2/1996 Apps
D374,555 S 10/1996 McMath
5,582,296 A 12/1996 Beauchamp et al.
5,609,254 A 3/1997 Loftus et al.
D379,718 S 6/1997 Raghunathan
D381,203 S 7/1997 Ackermann et al.
D384,975 S 10/1997 Jackson
5,711,444 A 1/1998 Meacham et al.
5,722,550 A 3/1998 Ficker
5,735,431 A 4/1998 LeTrudet
5,752,602 A 5/1998 Ackermann et al.
5,772,033 A 6/1998 Loftus et al.
D398,448 S 9/1998 Zanni
D400,711 S 11/1998 Hwang
D401,066 S 11/1998 Ackermann
D401,412 S 11/1998 LeTrudet
5,860,527 A 1/1999 Frankenberg et al.
5,881,902 A 3/1999 Ackermann
5,896,987 A 4/1999 Bettenhausen
5,896,992 A 4/1999 McGrath
5,913,424 A 6/1999 Kelly et al.
5,950,836 A 9/1999 Iwamoto et al.
5,960,720 A 10/1999 Borland et al.
5,975,324 A 11/1999 Schmitt
5,984,133 A 11/1999 Schutz
5,992,673 A 11/1999 Hwang
6,015,056 A 1/2000 Overholt et al.
D420,219 S 2/2000 Elvin-Jensen et al.
6,036,049 A 3/2000 Hwang
D423,217 S 4/2000 Varfeldt
D424,299 S 5/2000 Varfeldt
D429,565 S 8/2000 Aiken
6,098,827 A 8/2000 Overholt et al.
6,138,863 A 10/2000 Aiken
D436,729 S 1/2001 Aiken
6,179,156 B1 1/2001 Aiken
D439,049 S 3/2001 Koefelda
6,209,742 B1 4/2001 Overholt et al.
6,241,096 B1 6/2001 Littlejohn et al.
6,250,490 B1 6/2001 Loftus
6,260,706 B1 7/2001 Koefelda
D446,017 S 8/2001 Koefelda
D446,392 S 8/2001 Overholt et al.
D446,939 S 8/2001 Koefelda
6,273,259 B1 8/2001 Stahl
6,293,418 B1 9/2001 Ogden et al.
6,308,858 B1 10/2001 Koefelda
D452,614 S 1/2002 Overholt
6,338,181 B1 1/2002 Hwang
6,386,388 B1 5/2002 Overholt
6,394,274 B1 5/2002 Cheeseman
D458,753 S 6/2002 Overholt et al.
6,398,054 B1 6/2002 Overholt et al.
6,405,888 B1 6/2002 Overholt et al.
6,409,041 B1 6/2002 Overholt et al.

(56) References Cited

U.S. PATENT DOCUMENTS

| | | | | |
|---|---|---|---|---|
| D460,619 | S | 7/2002 | Koefelda | |
| D463,667 | S | 10/2002 | Hwang | |
| 6,460,717 | B1 | 10/2002 | Smyers et al. | |
| D478,421 | S | 8/2003 | Overholt et al. | |
| 6,601,724 | B1 | 8/2003 | Koefelda et al. | |
| 6,607,199 | B2 | 8/2003 | Gruber | |
| 6,631,822 | B1 | 10/2003 | Overholt | |
| 6,843,386 | B2 | 1/2005 | Raghunathan et al. | |
| 6,857,642 | B2 | 2/2005 | Gruber | |
| 6,863,180 | B2 | 3/2005 | Apps et al. | |
| 6,880,705 | B2 | 4/2005 | Otting et al. | |
| 6,886,710 | B2 | 5/2005 | Verna et al. | |
| 6,899,242 | B2 | 5/2005 | Overholt et al. | |
| 6,910,668 | B2 | 6/2005 | Henning | |
| 6,918,502 | B1 | 7/2005 | Overholt et al. | |
| 6,918,508 | B2 | 7/2005 | Hwang | |
| 6,938,772 | B2 | 9/2005 | Aiken et al. | |
| 6,994,216 | B2 | 2/2006 | Wong | |
| 7,014,043 | B2 | 3/2006 | Raghunathan et al. | |
| 7,017,745 | B2 | 3/2006 | Raghunathan | |
| 7,017,765 | B2 | 3/2006 | Overholt | |
| 7,017,766 | B2 | 3/2006 | Hsu et al. | |
| 7,044,319 | B2 | 5/2006 | Overholt et al. | |
| 7,048,134 | B1 | 5/2006 | Hagan | |
| 7,048,135 | B2 | 5/2006 | Smyers et al. | |
| 7,059,489 | B2 | 6/2006 | Apps et al. | |
| 7,063,210 | B2 | 6/2006 | Smyers et al. | |
| 7,063,223 | B2 | 6/2006 | Iwahara et al. | |
| 7,086,555 | B2 | 8/2006 | Overholt et al. | |
| 7,100,786 | B2 | 9/2006 | Smyers | |
| 7,104,414 | B2 | 9/2006 | Apps et al. | |
| 7,104,553 | B2 | 9/2006 | Gruber | |
| 7,128,231 | B2 | 10/2006 | Overholt | |
| 7,195,127 | B2 | 3/2007 | Hsu et al. | |
| 7,264,122 | B2 | 9/2007 | Koefelda et al. | |
| D553,859 | S | 10/2007 | Fernandez et al. | |
| D553,860 | S | 10/2007 | Fernandez et al. | |
| D553,861 | S | 10/2007 | Fernandez et al. | |
| D557,011 | S | 12/2007 | Fernandez et al. | |
| 7,320,405 | B2 | 1/2008 | Stahl | |
| 7,464,817 | B2 | 12/2008 | Raghunathan et al. | |
| 7,464,831 | B2 | 12/2008 | Aiken | |
| 7,478,726 | B2 | 1/2009 | Apps et al. | |
| 7,484,621 | B2 | 2/2009 | Apps et al. | |
| 7,549,550 | B2 | 6/2009 | Smyers et al. | |
| 7,637,373 | B2 | 12/2009 | Stahl | |
| 7,694,836 | B2 | 4/2010 | Overholt et al. | |
| 7,699,172 | B2 | 4/2010 | McTavish et al. | |
| 7,784,615 | B2 * | 8/2010 | Stahl | 206/511 |
| 7,823,728 | B2 | 11/2010 | Baltz | |
| 7,861,863 | B2 | 1/2011 | Meissen | |
| 7,861,864 | B2 | 1/2011 | Hassell et al. | |
| 7,891,491 | B2 | 2/2011 | Aiken et al. | |
| 7,922,001 | B2 | 4/2011 | Meers | |
| 8,047,369 | B2 | 11/2011 | Stahl | |
| 8,066,143 | B2 | 11/2011 | Baltz et al. | |
| 2003/0183549 | A1 * | 10/2003 | Verna et al. | 206/509 |
| 2004/0060844 | A1 * | 4/2004 | Stahl | 206/499 |
| 2004/0104231 | A1 | 6/2004 | Hassell et al. | |
| 2005/0183980 | A1 | 8/2005 | Fernandez et al. | |
| 2006/0070906 | A1 | 4/2006 | Verna et al. | |
| 2006/0180491 | A1 | 8/2006 | Zephir et al. | |
| 2006/0196800 | A1 * | 9/2006 | Baltz | 206/509 |
| 2006/0237341 | A1 | 10/2006 | McDade | |
| 2007/0000856 | A1 | 1/2007 | Verna et al. | |
| 2007/0144931 | A1 | 6/2007 | McTavish et al. | |
| 2007/0175790 | A1 | 8/2007 | Fernandez et al. | |
| 2007/0187276 | A1 * | 8/2007 | Stahl | 206/505 |
| 2007/0199845 | A1 | 8/2007 | Hartwall | |
| 2007/0209962 | A1 | 9/2007 | Fransen | |
| 2007/0246471 | A1 | 10/2007 | Hrovat | |
| 2008/0023426 | A1 | 1/2008 | Stahl | |
| 2008/0116099 | A1 | 5/2008 | Garcia | |
| 2010/0000900 | A1 | 1/2010 | Hassell | |
| 2010/0084304 | A1 | 4/2010 | Cavalcante | |
| 2011/0037237 | A1 | 2/2011 | Hassell | |
| 2011/0042259 | A1 | 2/2011 | Baltz | |

FOREIGN PATENT DOCUMENTS

| | | | |
|---|---|---|---|
| GB | 2129401 | A | 5/1984 |
| GB | 2137167 | A | 10/1984 |
| GB | 2141778 | A | 1/1985 |
| GB | 2171980 | A | 9/1986 |
| GB | 2180821 | A | 4/1987 |
| TW | 338405 | | 8/1998 |
| TW | 372539 | | 10/1999 |

OTHER PUBLICATIONS

International Search Report dated Jun. 19, 2012, issued in PCT/US12/29918 (2 pages).

International Preliminary Examination Report dated Sep. 10, 2002, issued in PCT/CA01/00640 (11 pages).

International Search Report dated Dec. 17, 2001, issued in PCT/CA01/00640 (4 pages).

Photographs of known 3-level basket with stainless steel bail arm; maker unknown, creation date unknown.

Office Action dated Jun. 2, 2005, issued in EP Application No. 01 931 263.6-2308 (3 pages).

Office Action dated May 27, 2004, issued in EP Application No. 01 931 263.6-2308 (2 pages).

Mexican Foreign Associate Letter dated May 9, 2006 with copy of Mexican Office Action issued in Mexican Appln. No. 2011009 dated Apr. 12, 2006 (5 pages).

International Preliminary Report on Patentability for PCT/US2012/029918 mailed Mar. 18, 2014.

* cited by examiner

High Product Clear Height (PCH) Position

Low Product Clear Height (PCH) Position

THREE TIERED TRAY

CROSS-REFERENCE TO RELATED APPLICATIONS

The present application claims the benefit of U.S. Provisional Patent Application No. 61/467,213 filed Mar. 24, 2011, the contents of which are incorporated herein by reference.

FEDERALLY SPONSORED RESEARCH OR DEVELOPMENT

N/A

FIELD OF THE INVENTION

The present invention generally relates to a basket or tray for carrying items, such as bakery products; and more particularly, to a bakery tray that can be stacked in any of three orientations upon another such tray to provide for three different clearance heights between trays.

DESCRIPTION OF THE PRIOR ART

A large variety of trays exist for transporting and storing bakery items, such as bread or other similar products U.S. Pat. No. 6,886,710 discloses a multi-purpose tray that can be stacked on a similar tray. The tray includes a front wall, a first side wall, a back wall and a second side wall extending upward from a rectangular bottom wall. When stacked in a similar orientation (the front, first side, second side and back walls of the top tray are positioned over the front, first side, second side and back walls, respectively, of the bottom tray), the top tray provides a first clearance height with respect to the bottom tray. That is, the bottom surface of the bottom wall of the top tray is a first distance from the top surface of the bottom wall of the bottom tray. This spacing is maintained as additional like trays are stacked on top of the first two trays in the same orientation. However, when a top tray is oriented 180° on a bottom tray (the front, first side, second side and back walls of the top tray are positioned over the back, second side, first side and front walls, respectively, of the bottom tray), the top tray provides a second clearance height with the bottom tray different than the first clearance height. This allows for flexibility in use of the trays to transport particular items.

Other trays allow for stacking at three different clearance height levels by providing a moveable bar or other moveable components to engage a like tray. One such tray includes a metal or plastic bail arm that is positioned along the top edge of the side walls. When the bail arm is in a first, down position, the trays stack at a first level with like walls aligned. When the bail arm is moved to a second, up position the trays stack at a second level with like walls aligned. Finally, with the bail arm in the up position, the trays stack at a third level with the top tray rotated 180° with respect to the lower tray so that the front wall of the top tray is aligned with the back wall of the bottom tray. The moveable parts require additional assembly (during manufacture) and handling (i.e., moving the arm) when used.

Due to the high volume of trays needed, it is important to make such trays as efficient as possible.

SUMMARY OF THE INVENTION

The present invention provides a basket or tray preferably formed from a molded plastic for carrying items, such as bakery-type items (e.g., bread, bagels, etc.), that provides additional flexibility in transporting such items. The tray includes a front wall, a first side wall, a second side wall and a back wall all extending upward from a bottom wall. The tray is provided with a variety of molded structures to enable one tray to stack on another like tray. In this regard, the present tray is configured to stack on like trays in any of three different orientations and provide three different clearance heights without having or requiring any moveable bars or other moveable components to facilitate such stacking. Accordingly a particular orientation can be utilized to choose the most efficient clearance height for the item at issue to maximize transportation volume.

The tray is provided with a square base to enable it to be stacked in any of the three orientations upon another similar tray. Each orientation involves particular structure to enable the stacked trays to provide a different clearance height between the upper surface of the bottom wall of the lower tray with the lower surface of the bottom wall of the upper tray.

In a first orientation, the front wall, first side wall, second side wall and back wall of a top or upper tray are positioned directly over the front wall, first side wall, second side wall and back wall of a bottom or lower tray. In this orientation, the trays stack in a manner to provide a first clearance height between the bottom surface of the bottom wall of the upper tray and the top surface of the bottom wall of the lower tray.

In a second orientation, the upper tray is rotated 180 degrees so that the front wall of the upper tray is positioned over the back wall of the lower tray and the back wall of the upper tray is positioned over the front wall of the lower tray. This places the first side wall of the upper tray over the second side wall of the lower tray and the second side wall of the upper tray over the first side wall of the lower tray. In this orientation, a second clearance height is provided between the upper tray and the lower tray different than the first clearance height.

The trays can be stacked in a third orientation in one of two ways. In a first way, the upper tray can be turned 90° counter-clockwise. In this position, the front wall of the upper tray is positioned over the first side wall of the lower tray and the back wall of the upper tray is positioned over the second side wall of the lower tray. In this position, the first side wall of the upper tray is positioned over the back wall of the lower tray and the second side wall of the upper tray is positioned over the front wall of the lower tray. In the second way, the tray is turned 90° clockwise. In this position, the front wall of the upper tray is positioned over the second side wall of the lower tray and the back wall of the upper tray is positioned over the first side wall of the lower tray. This causes the first side wall of the upper tray to be positioned over the front wall of the lower tray and the second side wall of the upper tray to be positioned over the back wall of the lower tray.

In accordance with one embodiment of the invention, a third clearance height is provided (different than both the first clearance height and the second clearance height) regardless of which way is used (e.g., clockwise or counter-clockwise) to achieve the third orientation. However, in accordance with another embodiment of the invention, each way could provide a different clearance height in order to enable the tray to have four different clearance heights.

In accordance with one embodiment of the invention, a tray is provided for transporting items. The tray comprises a bottom wall supporting first and second side walls, a front wall and a back wall, each of the side walls, front wall and back wall extending upward from a top surface of the bottom wall. The tray includes a non-moveable first stacking structure for stacking the tray with a like tray in a first orientation to provide a first clearance height between the trays, a non-moveable second stacking structure for stacking the tray with a like tray in a second orientation to provide a second clearance height between the trays different than the first clearance height and, a non-moveable third stacking structure on the tray for stacking the tray with a like tray in a third orientation to provide a third clearance height between the trays different than the first clearance height and the second clearance height. The tray can be formed from molded plastic or other suitable materials.

The first stacking structure can include a first foot structure positioned at a first distance from the front wall on an outer lower portion of the first side wall and a first upper ledge portion aligned with the first foot structure. The first stacking feature also includes a second foot structure positioned at a first distance from a back wall on the outer lower portion of the first side wall and a second upper ledge portion aligned with the second lower foot structure. This first distance can be close to or at the end of the side wall close to the front or back wall respectively.

The first stacking structure can further include a first foot structure positioned a second distance from the front wall greater than the first distance on an outer lower portion of the second side wall and a first upper ledge portion on the second side wall aligned with the first foot structure of the second side wall. Also, the first stacking feature includes a second foot structure positioned the second distance from the back wall on the outer lower portion of the second side wall and a second upper ledge portion on the second side wall aligned with the second foot structure of the second side wall. The first stacking feature provides a first product clearance height between two stacked trays.

The second stacking structure can include a first upper ledge portion and a second upper ledge portion on the front wall and a first upper ledge portion and a second upper ledge portion on the back wall. The first upper ledge portion and the second upper ledge portion on the front wall and the first upper ledge portion and the second upper ledge portion on the back wall are lower than the first upper ledge portion and second upper ledge portion of the first side wall and the first upper ledge portion and second upper ledge portion of the second side wall. This provides a second product clearance height between two trays when stacked.

The third stacking structure can include a first lower ledge portion on the first side wall at the second distance from the front wall, and a second lower ledge portion at the second distance from the back wall. It also includes a first lower ledge portion on the second side wall at the first distance from the front wall and a second lower ledge portion the first distance from the back wall. The first and second lower ledge portion of the first side wall and the first and second lower ledge portions of the second side wall are lower than the first and second upper ledge portions of the front wall and the first and second upper ledge portions of the back wall. This provides a third product clearance height between two trays when stacked.

The first stacking structure is configured to require the tray to be stacked on the like tray with the first and second side walls, front wall and back wall of the tray being aligned with the first and second side walls, front wall and back wall, respectively, of the like tray. The second stacking structure is configured to require the tray to be stacked on the like tray with a 90° rotation from an alignment of the first and second side walls, front wall and back wall of the tray with the first and second side walls, front wall and back wall, respectively, of the like tray. The third stacking structure is configured to require the tray to be stacked on the like tray with a 180° rotation from an alignment of the first and second side walls, front wall and back wall of the tray with the first and second side walls, front wall and back wall, respectively, of the like tray.

In accordance with another embodiment of the invention, a tray for transporting items comprises a square bottom wall supporting a first side wall and a second side wall, a front wall and a back wall, each of the side walls, front wall and back wall extending upward from a top surface of the bottom wall. The tray includes a first bottom support structure and a first top structure. The first bottom structure is configured to mate with the first top structure so that when the tray is stacked on a second like tray with the front wall of the tray aligned with and positioned over the front wall of the second tray, the two trays stack to a first height between an upper surface of the bottom wall of the second tray and the bottom surface of the tray.

The tray includes a second top structure. The first bottom support structure is configured to mate with the second top structure so that when the tray is stacked on a second like tray with the front wall aligned with and positioned over one of the first and second side walls of the second tray, the two trays stack to a second height between the upper surface of the bottom wall of the second tray and the bottom surface of the tray that is different from the first height.

The tray also includes a third top structure. The first bottom support structure is configured to mate with the third top structure when the tray is stacked on a second identical tray with the front wall of the first tray aligned with and positioned over the back wall of the second tray, the two trays stack to a third height between the upper surface of the bottom wall of the second tray and the bottom surface of the tray that is different than the first height and the second height.

The bottom support structure can comprise a first foot structure positioned on a lower outer portion of the first side wall proximate the front wall, a second foot structure positioned on the lower outer portion of the first side wall proximate the back wall. The bottom structure can also comprise a first foot structure positioned on a lower outer portion of the second side wall a first distance from the front wall, and a second foot structure positioned on the lower outer portion of the second side wall the first distance from the back wall.

The first top structure can comprise a first upper ledge portion at a first height above the bottom wall on the first side wall aligned with the first foot structure of the first side wall, a second upper ledge portion at the first height above the bottom wall on the first side wall aligned with the second foot structure of the first side wall. The first top structure can also comprise a first upper ledge portion on the second side wall at the first height above the bottom wall aligned with the first foot structure on the second side wall, and a second upper ledge portion on the second side wall at the first height above the bottom wall aligned with the second foot structure of the second side wall.

The second top structure can comprise a first upper ledge portion on the front wall at a second height above the bottom wall lower than the first height positioned to support one of the first foot structure of the first side wall and the first foot structure of the second side wall of a like tray, a second upper ledge portion on the front wall at the second height above the bottom wall to support one of the second foot structure of the first side wall and the second foot structure of the second side wall of a like tray. The second top structure can also comprise a first upper ledge portion on the back wall at the second height above the bottom wall positioned to support one of the first foot structure of the first side wall and the first foot structure of the second side wall of a like tray, and a second upper ledge portion on the back wall at the second height above the bottom wall positioned to support one of the second foot structure of the first side wall and the second foot structure of the second side wall of a like tray.

The third top structure can comprise a first lower ledge portion on the first side wall at a third height above the bottom wall lower than the second height positioned the first distance from the front wall, a second lower ledge portion on the first side wall at the third height above the bottom wall positioned the first distance from the back wall. The third top structure can also comprise a first lower ledge portion on the second side wall at the third height above the bottom wall positioned proximate the front wall, and a second lower ledge portion at the third height above the bottom wall proximate the back wall.

In practice, the trays can be stacked manually or by stacking machinery. Stacking machinery is typically arranged or configured to place one tray vertically on top of a lower tray in perfect alignment (i.e., the four walls of the top tray are positioned above four walls of the bottom tray—the exact walls depending on the orientation of the top tray with respect to the bottom tray). However, in a typical manual stacking operation, an upper tray is placed on the lower tray so that two of the foot structures are positioned somewhere along the upper ledge or channel portions, and the tray is then slid over until the walls are aligned. In certain orientations, the foot structures will slide until they encounter the lower ledge or channel portions. That is, the foot structure rides the ledge until it drops in the wells created by the lower ledge or channel portions. The lower ledge or channel portions can include ramps to facilitate the sliding on procedure, or can be used in a reverse manner to allow one to manually slide the top tray off the lower tray.

Further aspects of the invention are disclosed in the description of the invention, including the Figures and/or Attachments.

BRIEF DESCRIPTION OF THE DRAWINGS AND ATTACHMENTS

To understand the present invention, it will now be described by way of example, with reference to the accompanying drawings and/or attachments in which.

DETAILED DESCRIPTION

Figure 1:
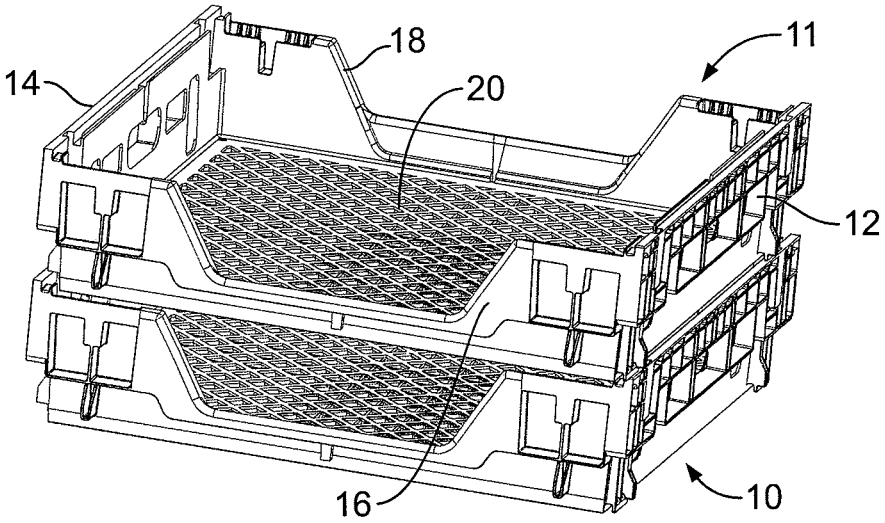
FIG. 1 is a perspective view of a first tray and an identical second tray stacked on the first tray in the same orientation as the first tray in accordance with the present invention.
Figure 2:
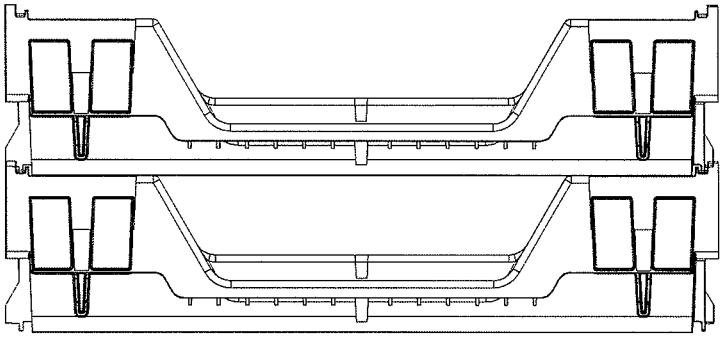
FIG. 2 is a front view of the first tray and second tray of FIG. 1.
Figure 3:
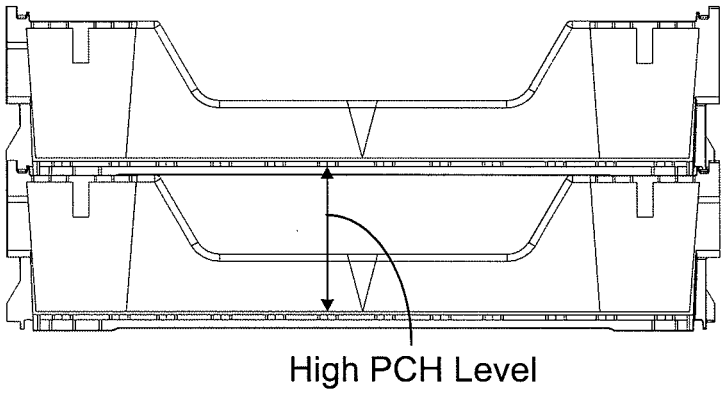
FIG. 3 is a front cross-sectional view of the first tray and second tray of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures disclose a plastic tray for transporting items such as bakery products. The tray includes a front wall, first and second side walls and a back wall extending upward from a square bottom wall. The tray is configured to allow one tray to stack on another identical or substantially identical tray in any orientation. That is, the trays include stacking structures so that the trays can be in one of three different configurations: (1) in a first configuration a top tray can align with a bottom tray when stacked upon it (i.e., all of the front, side and back walls of the top tray align with the front, side and back walls of the bottom tray); (2) in a second configuration the top tray can be turned 90° to the right, or clockwise, or 90° to the left, or counterclockwise (i.e., the side walls of the top tray are positioned over the front and back walls of the bottom tray); or (3) in a third configuration the top tray can be turned 180° around (i.e., the back wall of the top tray is aligned or positioned over the front wall of the bottom tray, and the front wall of the top tray is aligned or positioned over the back wall of the bottom tray). The trays are further designed so that each stacking configuration provides a different clearance height—the space between the top surface of the bottom wall of the lower tray and the bottom surface of the bottom wall of the top tray—for items (e.g., bakery products) placed on the lower tray. This allows for use of the trays at three different clearance heights which can be utilized in the most efficient manner depending on the type of items or products (i.e., the height of the items or products) being transported.

The stacking features of the trays do not include any moveable bars or other moveable components. Rather, it is the orientation of one tray with the next that determines the clearance height. In this regard, the stacking structures are preferably molded into the trays.

In one embodiment, the tray 10 includes a front and a back and two side walls extending upward from the base. The two side walls each include a handle. Each of the front wall and back wall includes an opening which allows for visible inspection of the contents in the tray even when another tray is stacked on it.

FIGS. 1-3, 4-6 and 7-9 show a first, bottom tray 10 made in accordance with the present invention, and a second, top tray 11 stacked on the first tray 10 in the three different configurations (while only two trays are shown, additional trays can be stacked on the first and second trays 10, 11 in a similar manner). The first and second trays 10, 11 are identical and/or are substantially similar in that both have the appropriate structures to stack upon each other in the various configurations described herein to achieve the desired clearance heights (in accordance with certain embodiments it is acceptable for the trays to be different with respect to characteristics that are unrelated to the stacking structures).

Each tray 10, 11 includes a right side wall 12 and an opposing left side wall 14 (directional qualifiers are used with respect to the orientation of the tray or trays as shown in the Figures and are not meant to limit the scope of the invention—for example, the right and left side walls could also be referred to as the first and second side walls, which would be true regardless of the orientation or viewpoint of the tray in the Figure). The side walls 12, 14 may also be sometimes referred to as end walls.

The trays 10, 11 also include a front wall 16 and a back wall 18. Each of the side walls 12, 14, front wall 16, and back wall 18 extend upward and surround a square bottom wall 20. The right and left side walls 12, 14 extend to a top edge 21 having a first height above the bottom wall 20. The top edge 21 extends substantially from one end of each side wall 12, 14 to an opposing second end (i.e. from the juncture with the front wall 16 to the juncture with the back wall 18).

In FIG. 1, the trays 10, 11 are stacked in the first configuration—with each of the side, front and back walls 12, 14, 16, 18 of the top tray 11 aligning with the side, front and back walls 12, 14, 16, 18 of the bottom tray 10. That is, the second tray 11 of FIG. 1 is positioned in the same orientation as the first tray 10 so that each of the side, front and back walls 12, 14, 16, 18 of the second tray 11 are directly over the corresponding side, front and back walls 12, 14, 16, 18 of the first tray 10.

In this configuration, the trays 10, 11 stack with each other to provide a first product clearance position having a first product clearance height for items placed on the lower tray 10. This first product clearance height (identified in FIG. 3 as the "High PCH Level") would be maintained as further like trays are stacked upon the top tray 11 in the same configuration or orientation. The product clearance height is the distance between an upper surface of the bottom wall 20 of the bottom tray 10 with a bottom surface of the bottom wall 20 of the upper tray 11.

Figure 4:
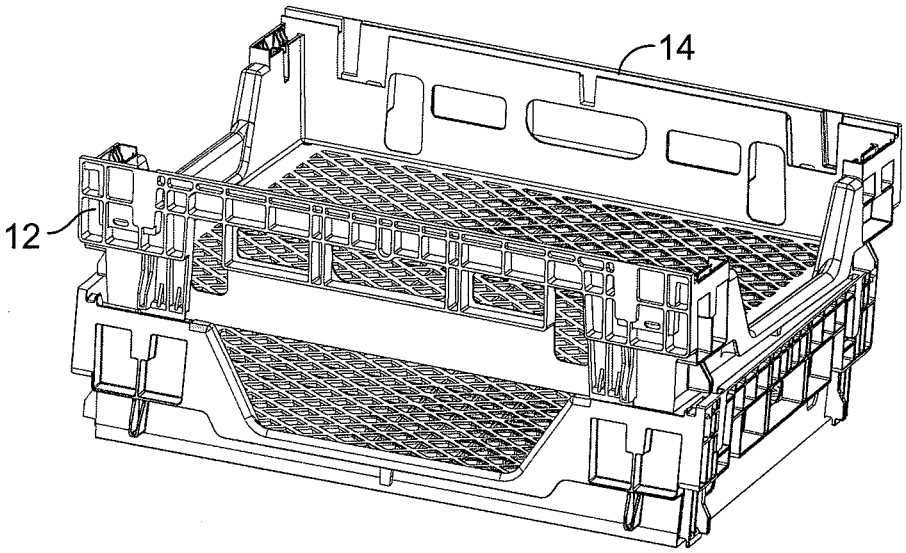
FIG. 4 is a perspective view of the first tray and the second tray of FIG. 1 with the second tray rotated 90°.
Figure 5:
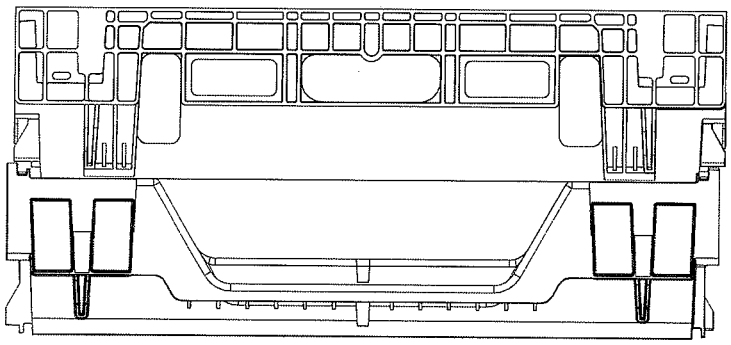
FIG. 5 is a front view of the first tray and second tray of FIG. 4.
Figure 6:
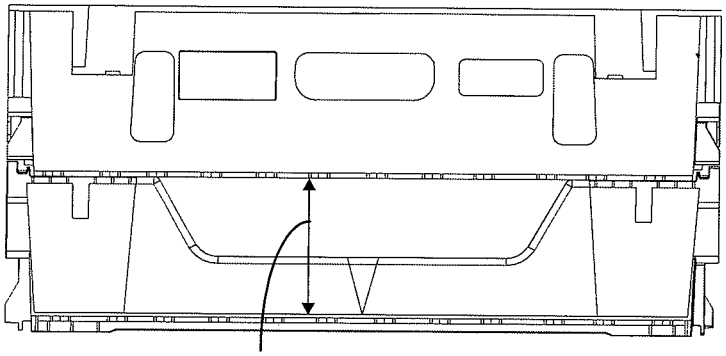
FIG. 6 is a front cross-sectional view of the first tray and second tray of FIG. 4.

Referring to FIGS. 4-6, the second tray 11 is stacked on the first tray 10 in the second configuration. In this embodiment, the second tray has been rotated 90° counterclockwise so that the side walls 12, 14 of the second tray 11 are positioned over the front and back walls 16, 18, respectively, of the first tray 10.

In this configuration, the first and second trays 10, 11 stack at a second product clearance height less than the first product clearance height (identified in FIG. 6 as the "Mid PCH Level").

Figure 7:
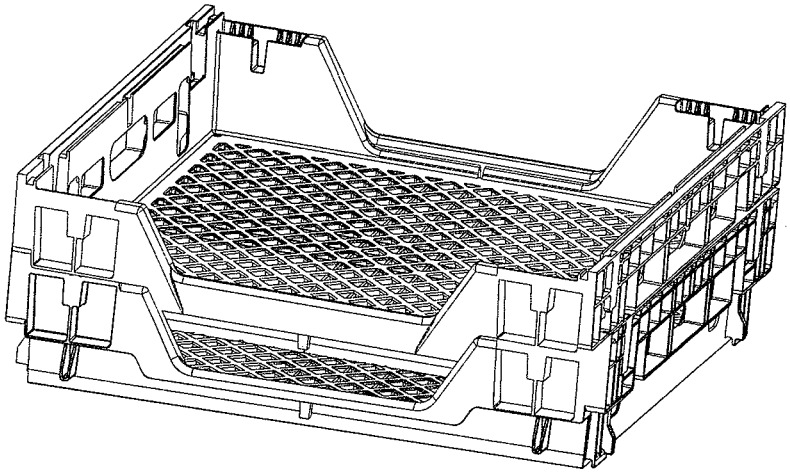
FIG. 7 is a perspective view of the first tray and the second tray of FIG. 1 with the second tray rotated 180°.
Figure 8:
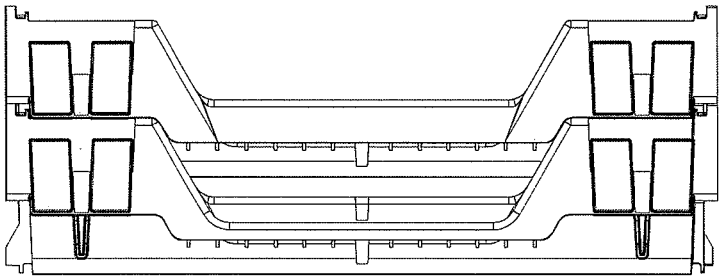
FIG. 8 is a front view of the first tray and second tray of FIG. 7.
Figure 9:
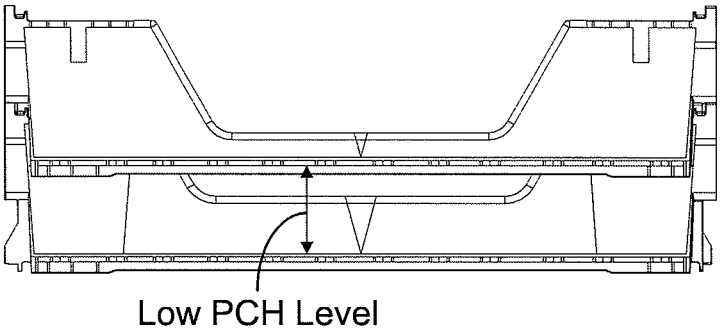
FIG. 9 is a front cross-sectional view of the first tray and second tray of FIG. 7.

FIGS. 7-9 show the second tray 11 stacked on the first tray 10 in the third configuration in which the back wall 18 of the second tray 11 is aligned with and positioned over the front wall 16 of the first tray 10 and the front wall 16 of the second tray 11 is aligned with and positioned over the back wall 18 of the first tray 10. In this embodiment, the second tray 11 is rotated 180° with respect to the first tray 10.

In this configuration the first and second trays 10, 11 stack at a third product clearance height that is less than the second product clearance height (and therefore also less than the first product clearance height).

Figure 10:
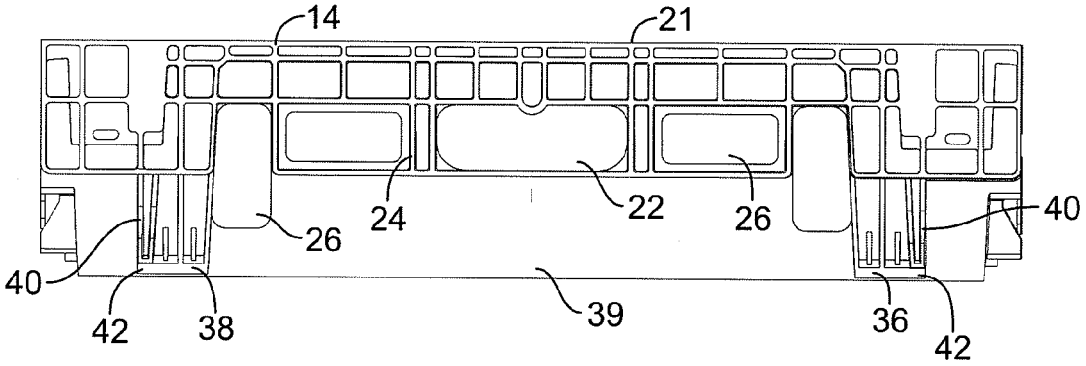
FIG. 10 is a left side view of the first or second tray of FIG. 1.
Figure 11:
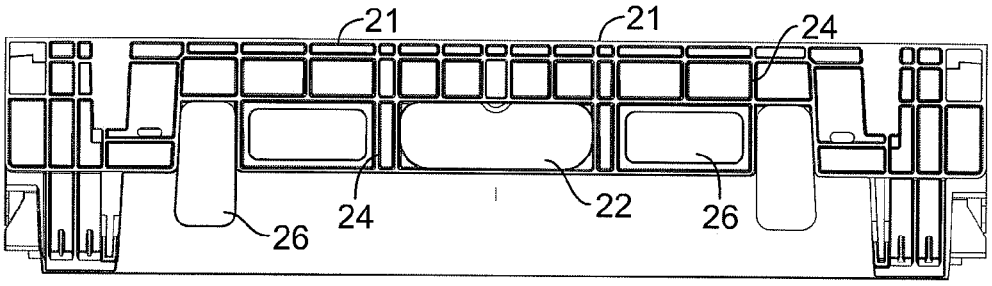
FIG. 11 is a right side view of the first or second tray of FIG. 1.

Referring to FIGS. 10 and 11, the left side wall 14 and the right side wall 12 are shown in detail. Each of these side walls 12, 14 includes a central opening 22 that can be used as a handle for carrying the tray 10, 11. Other handle structures could also be employed. Each of the side walls 12, 14 also include a plurality of ribs 24 that extend outward from the side wall 12, 14. The ribs 24 provide rigidity and strength for the side wall 12, 14. Additional openings 26 can be provided to reduce the weight and cost of the tray and to allow for visual inspection of the products.

Figure 12:
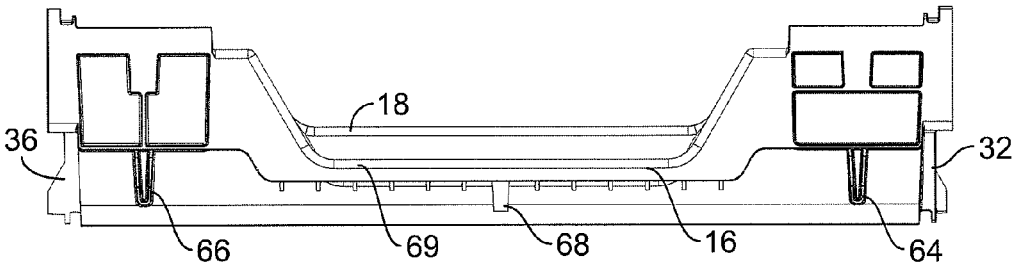
FIG. 12 is a front side view of the first or second tray of FIG. 1.

FIG. 12 shows the front wall 16 of the tray. The central portion of the front wall 16 is cut-away to allow for inspection of product on the tray when stacked.

Figure 13:
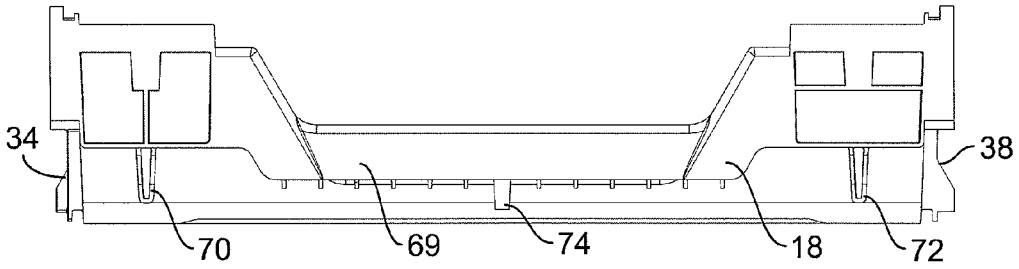
FIG. 13 is a back side view of the first or second tray of FIG. 1.

FIG. 13 shows the back wall 18 of the tray. Similar to the front wall 16, the back wall 18 includes a central portion cut-away for inspection. In this central portion, the back wall 18 is higher than the front wall 16. This enables the user to easily distinguish the two walls and the orientation of the tray.

Figure 14:
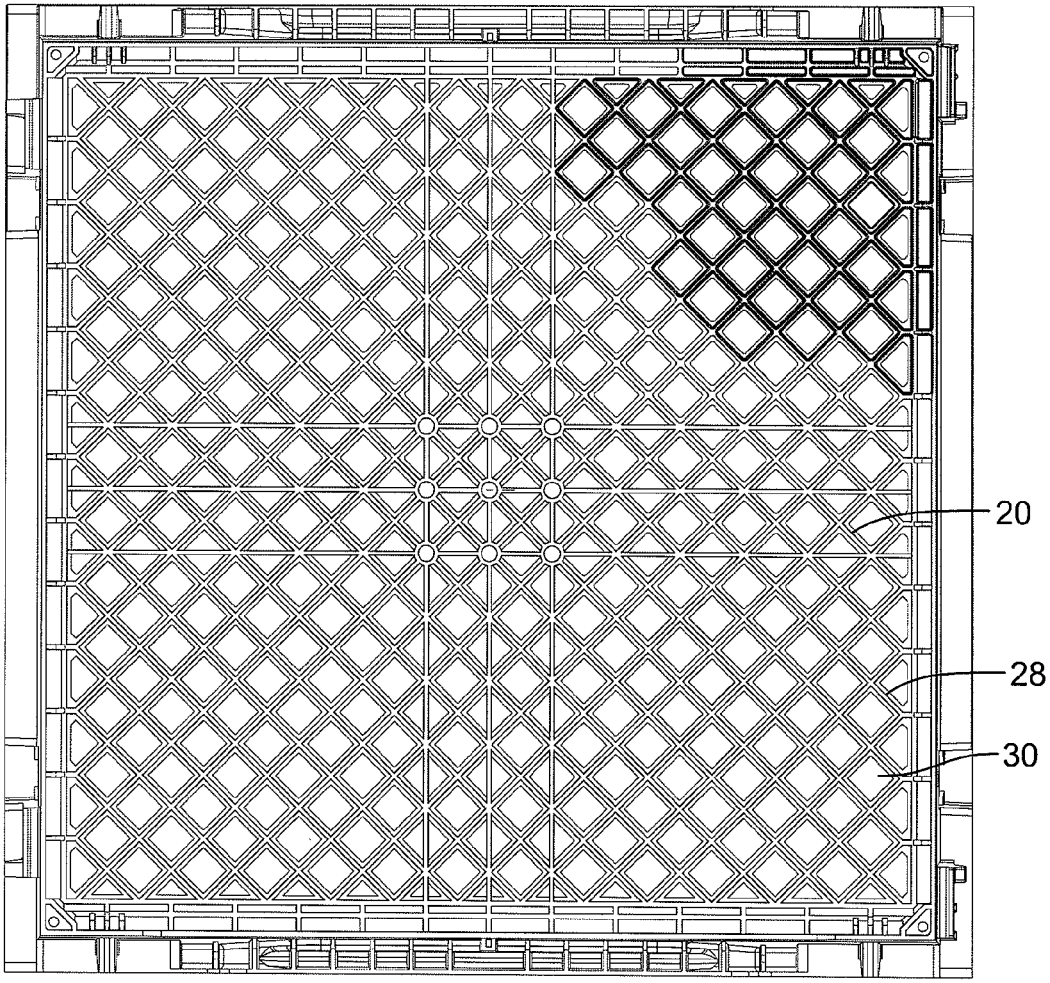
FIG. 14 is a bottom plan view of the tray of FIG. 1.
Figure 15:
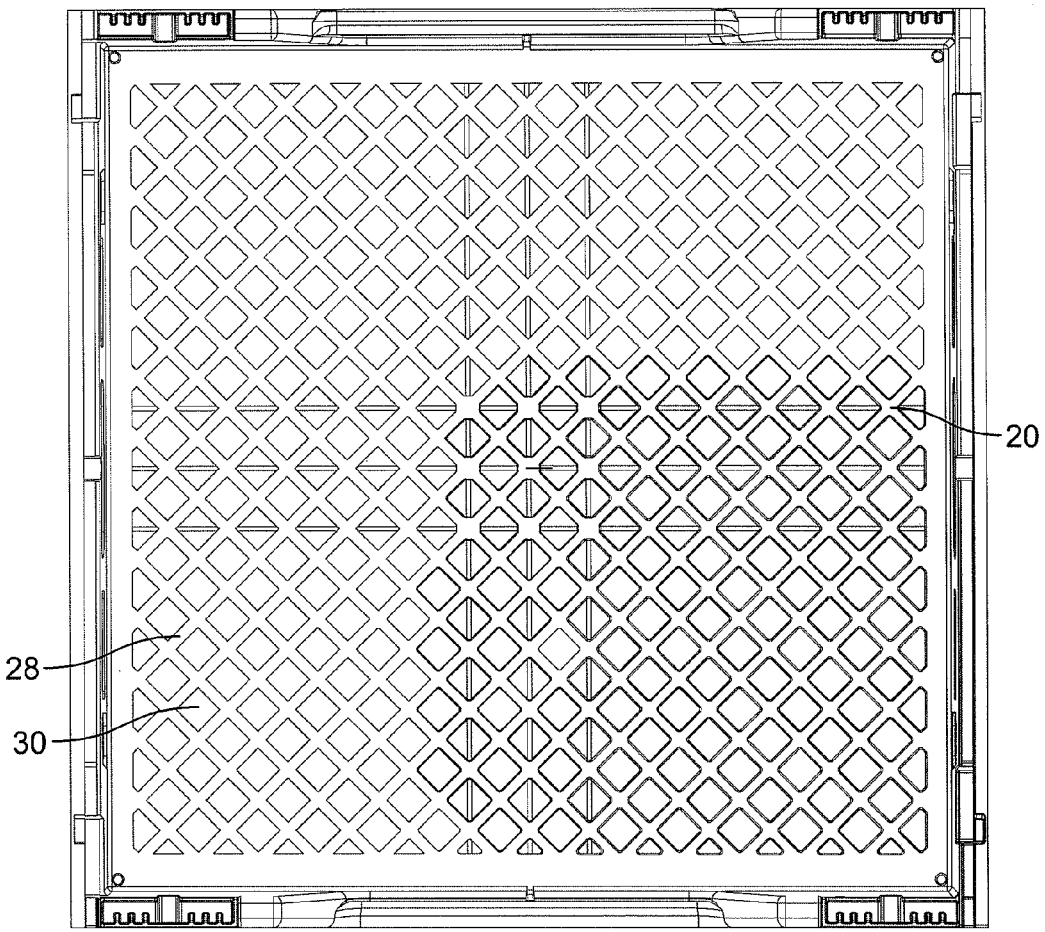
FIG. 15 is a top plan view of the tray of FIG. 1.

FIG. 14 is a bottom plan view of the tray showing the bottom wall 20 having a generally square shape. FIG. 15 shows a top plan view of the tray. As illustrated, the bottom wall 20 is formed as a lattice of ribs 28 defining square shaped openings 30 therebetween.

Figure 16:
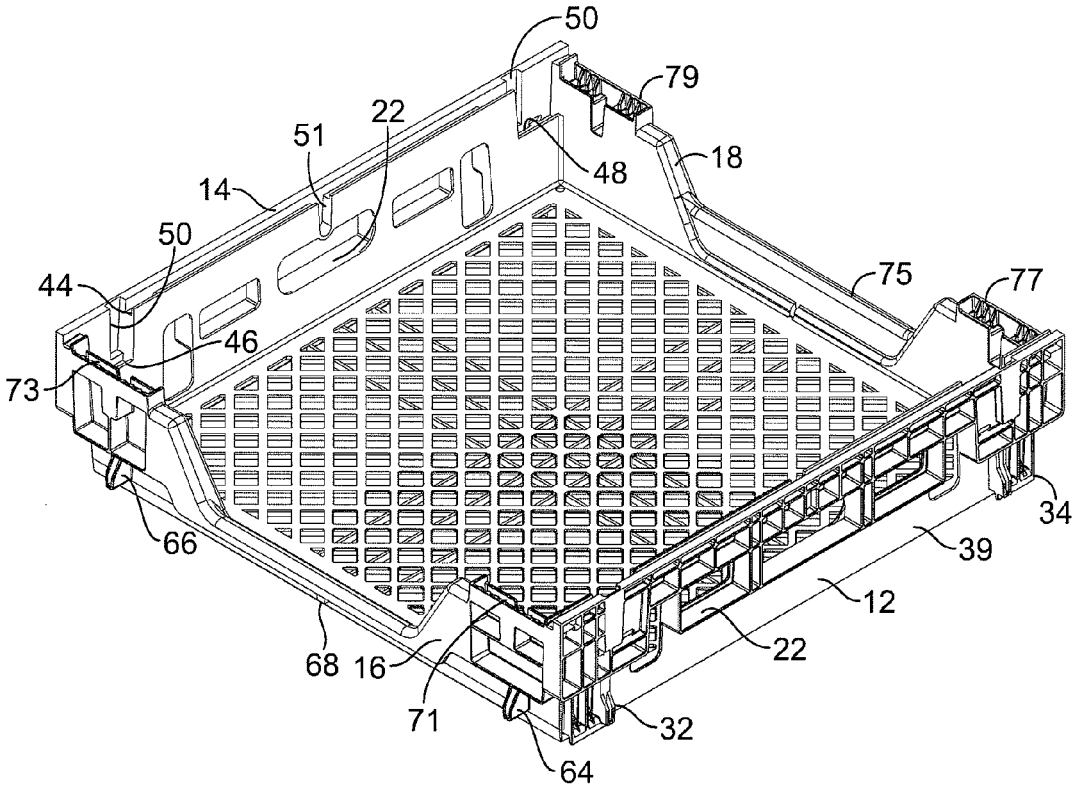
FIG. 16 is a perspective view of the tray of FIG. 1 showing an outer surface of the right side wall.
Figure 17:
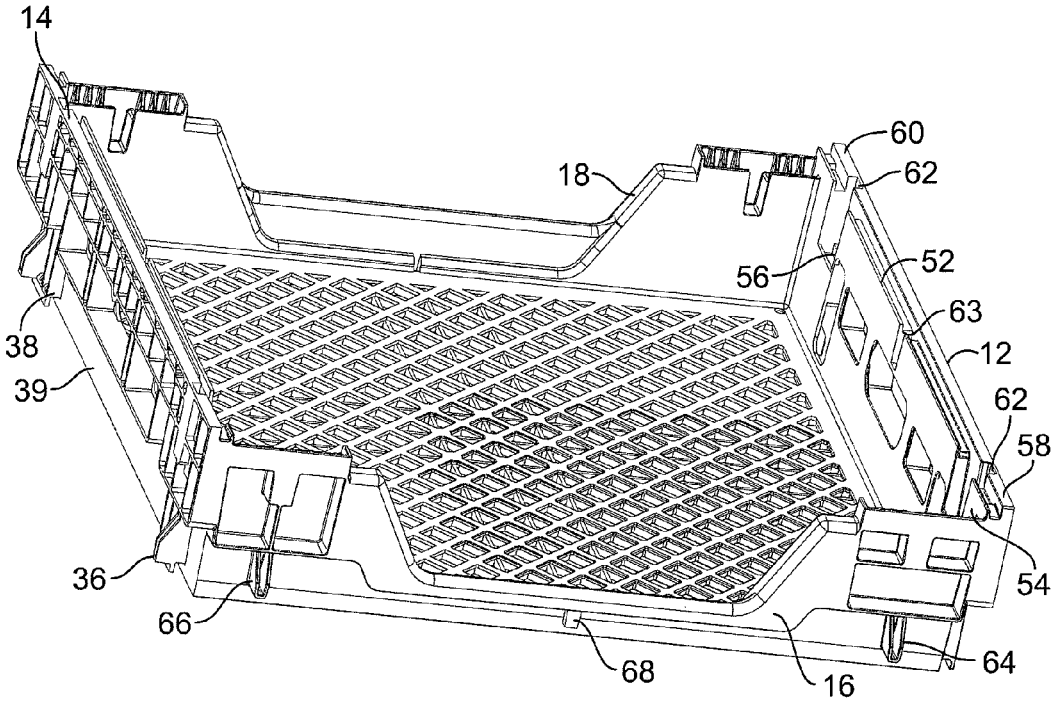
FIG. 17 is a perspective view of the tray of FIG. 1 showing an outer surface of the left side wall; and, FIG. 18 is an enlarged perspective view of the first foot structure of FIG. 17.

FIG. 16 is a perspective view of the tray 10 or 11 oriented to show the outer side of the front wall 16 and the right side wall 12, and FIG. 17 is a perspective view of the tray oriented to show the outer side of the front wall 16 and the left side wall 14.

With reference to FIGS. 16 and 17, the right side wall 12 is provided with a first foot structure 32 and a second foot structure 34. The foot structures 32, 34 are positioned proximate the extreme ends of the side wall 12 near the junctures or corners with the front wall 16 and back wall 18, respectively. The left side wall 14 includes a first foot structure 36 and a second foot structure 38. These foot structures 36, 38 are positioned so that they are spaced a first distance from the front wall 16 or back wall 18. Each of the foot structures 32, 34, 36, 38 is positioned in a lower half 39 the respective side wall 12, 14 and extend outward from the side wall 12, 14. While the foot structures of the right side wall 12 are shown proximate the ends of the wall, they could alternatively be positioned at other locations along the wall as long as they are not at the same location as the foot structures on the left side wall 14.

Figure 18:
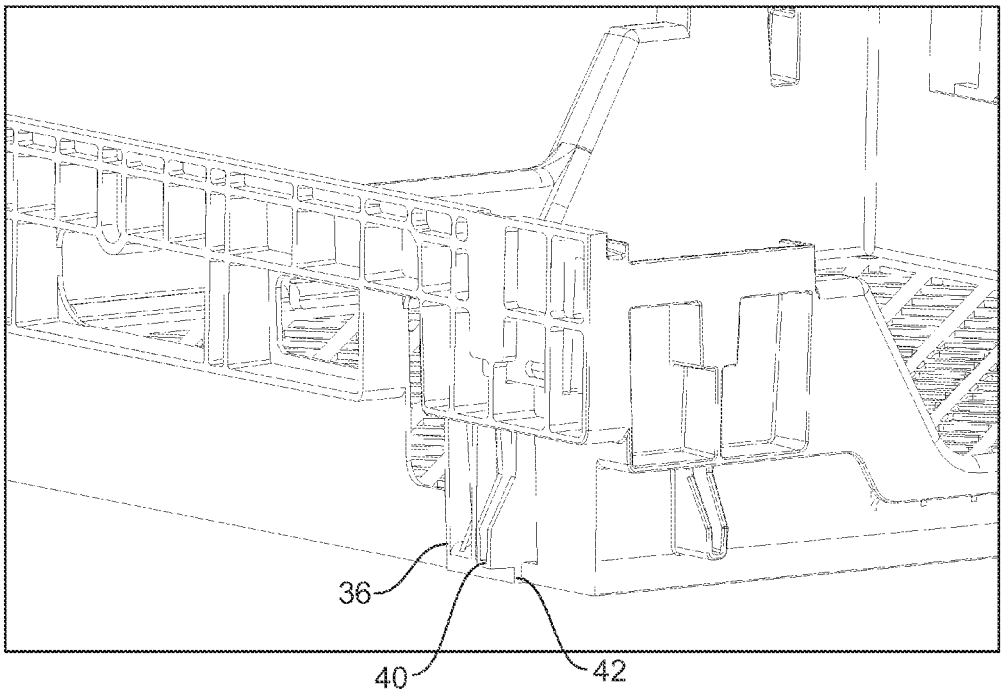

As illustrated in the enlarged view in FIG. 18, the foot structure 36 includes a guide 40 that extends outward from the tray farther than the remainder of the structure. The lower rib 42 extends along the bottom of the foot structure 36 and is spaced from the lower portion 39 of the side wall. Each of the other foot structures 32, 34 and 38 have similar features.

Referring to FIG. 16, the interior of the left side wall 14 includes a stepped ledge or channel having a central upper portion 44 level with, or slightly lower than the top edge 21 of the side wall 14. The side wall 12 also includes a first lower ledge or channel portion 46 and a second lower ledge or channel portion 48. Importantly, the first lower ledge or channel portion 46 and second lower ledge or channel portion 48 are aligned with and sized in accordance with the first foot structure 32 and second foot structure 34 of the right side wall 12. Each lower ledge or channel portion includes a vertical slot 50. The central upper ledge or channel portion 44 also includes a centrally located slot 51.

The upper and lower ledge or channel portions are support structures or surfaces on the inner side of the respective walls. The upper ledge or channel portions are near or at the top of the walls, and the lower portions are positioned below the upper portions and include recesses in the walls to allow for positioning of the foot structures.

Similarly, with reference to FIG. 17, the interior of the first side wall 12 includes a stepped ledge or channel having a central upper portion 52 level with or slightly lower that the top edge 21 of the right side wall 12, a first lower ledge or channel portion 54 and a second lower ledge or channel portion 56. In this instance, the first lower ledge or channel portion 54 and second lower ledge or channel portion 56 are aligned with and sized in accordance with the first foot structure 36 and second foot structure 38 of the left side wall 14. In this regard, the first lower ledge or channel portion 54 and second lower ledge or channel portion 56 are spaced the same first distance from the front wall 16 and back wall 18, respectively, so that the first side wall 12 also includes a first upper ledge or channel end segment 58 and second upper ledge or channel end segment 60 level with the central upper portion 44. The first upper ledge or channel end segment 58 and second upper ledge or channel end segment 60 are positioned proximate the juncture of the right side wall 14 with the front wall 16 and back wall 18, respectively. The first lower ledge or channel portion 54 and second lower ledge or channel portion 56 also include a vertical slot 62. The central upper ledge or channel portion 52 also includes a centrally located slot 63.

Referring to FIGS. 12, 16 and 17, the front wall 16 is provided with a first guide 64 and a second guide 66 positioned a short distance from the right side wall 12 and left side wall 14, respectively. The front wall 16 also includes a central guide 68 positioned proximate a center point of the front wall 16. The guides 64, 66, 68 extend outward from a recessed lower portion of the front wall 16.

The front side wall 16 includes a central lower wall portion 69 to allow for visible inspection of the product. At either end of the central lower wall portion, the front side wall 16 also includes a first upper ledge or channel portion 71 and a second upper ledge or channel portion 73.

Referring to FIG. 13, the back wall 18 similarly includes a first guide 70 and a second guide 72 positioned a short distance from the right side wall 12 and left side wall 14, and a center guide 74. The guides 70, 72, 74 extend outward from a recessed lower portion of the back wall 18. The back side wall 18 also includes a central lower wall portion 75, and a first upper ledge or channel portion 77 at one end and a second upper ledge or channel portion 79 at the other end. The upper ledge or channel portions of the front and back walls 16, 18 are slightly lower than the upper channel portions of the right side wall 12 and left side wall 14.

The positioning of the foot structures, guides, slots, and upper and lower ledge or channel portions or segments enables two like trays (having at least similar stacking structure in this regard) to stack in a manner to provide the different product clearance heights. Each height depends on the orientation between the lower tray and the upper tray.

In the first configuration (shown in FIGS. 1-3), the foot structures 32, 34 on the right side wall 12 of an upper tray 11 are positioned to rest on the first ledge or channel end segment 58 and second ledge or channel end segment 60 of the right side wall of the lower tray 10. The first and second foot structures 36, 38 of the left side wall 14 of the upper tray 11 rest on the central upper ledge or channel portion 44 of the lower tray 10. In this configuration, like walls are positioned above each other.

In the second configuration, the upper tray 11 is rotated 90° counterclockwise. In this configuration, the first foot structure 32 of the right side wall 12 of the upper tray 11 is positioned to rest on the first upper ledge or channel portion 77 of the back wall 18 of the lower tray 10, and the second foot structure 34 is positioned to rest on the second upper ledge or channel portion 79. The first foot structure 36 of the left side wall 14 of the upper tray 11 is positioned to rest on the first upper ledge or channel portion 71 of the front wall 16 of the lower tray 10, and the second foot structure 38 is positioned to rest on the second upper ledge or channel portion 73. Additionally, the center guide 68 of the front wall 16 of the upper tray 11 is positioned to fit in the slot 63 of the right side wall, and the center guide 74 of the back wall 18 is positioned to fit in the slot 51 of the left side wall 14. Because the upper ledge or channel portions of the front and back side walls are lower than those on the right and left side walls, the product clearance height in the second configuration is less than the product clearance height in the first configuration.

In the third configuration, the upper tray 11 is positioned 180° around with respect to the lower tray 10. In this configuration, the front wall 16 and the back wall 18 of the upper tray 11 are positioned over the back wall 18 and the front wall 16 of the lower tray 10, respectively. The right side wall 12 of the upper tray 11 is positioned over the left side wall 14 of the lower tray 10, and the left side wall 14 of the upper tray 11 is positioned over the right side wall 12 of the lower tray 10.

In the third configuration, the foot structure 32 of the right side wall 12 of the upper tray 10 rests on the lower ledge or channel 48 of the left side wall 14 of the lower tray 10 with the guide 40 being positioned in the slot 50, and the foot structure 34 rests on the lower ledge or channel 46, again with the guide 40 being positioned in the slot 50. Similarly, the foot structure 36 of the left side wall 14 of the upper tray 11 is positioned in the lower ledge or channel portion 56 of the right side wall 12 of the lower tray 10, and the foot structure 38 is positioned on the lower ledge or channel portion 58, again with the guides 40 being positioned in the respective slots 62. Because the lower ledge or channel portions 56, 58 are lower than the ledge or channel portions of the front wall 16 and back wall 18, the product clearance height in this configuration is less than the second configuration (and therefore also the first configuration).

Because the upper ledge or channel portions of the front wall 16 and back wall 18 are all the same height, it doesn't matter if the upper tray is turned 90° clockwise or counterclockwise. However, because the foot structures of the right side wall 12 are not aligned with the foot structures of the left side wall 14, it is possible to form another embodiment of the invention where the upper ledge or channel portions in the front wall 16 and back wall 18 have two different levels so that movement clockwise provides one product height level and movement counterclockwise provides a different product height level. The trays would be able then to be positioned to have one of four different product height levels.

While the right and left side walls include a central upper ledge or channel portion that extends substantially from one end to the other of the side wall, it is evident the central portion on the right side wall only needs to accommodate the center guide of either the front side wall or the back side wall, and the central portion of the left side wall only needs to accommodate the foot structures of the left side wall of a like tray as well as the center guide. The remaining portions can be removed if desired.

As set forth above, the structures for stacking the trays in the various orientations and clearance heights are not moveable (and are preferably integrally formed with the other aspects of the tray). Accordingly, such trays do not require bail arms. This reduces the cost and time to manufacture such trays as well as any set up requiring movement of the bail arm. Additionally, such trays do not have any other problems associated with moving parts (e.g., repair or part replacement).

Many modifications and variations of the present invention are possible in light of the above teachings. It is, therefore, to be understood within the scope of the appended claims the invention may be protected otherwise than as specifically described.

I claim:

1. A tray stackable with a like tray in three different orientations, each orientation for transporting bakery items comprising:

a generally square bottom wall supporting upwardly extending first and second side walls, a front wall and a back wall, the front wall having a central lower wall portion having a height less than a height of the first and second side walls for visible inspection of an interior of the tray, a first non-moveable stacking structure for stacking the tray with a like tray in a first orientation to provide a first clearance height for accommodating bakery items between the trays, wherein the first non-movable stacking structure includes a first foot structure positioned at a first distance from the front wall on an outer lower portion of the first side wall and a first upper ledge portion on the first side wall aligned with the first foot structure and a second foot structure positioned at a first distance from a back wall on the outer lower portion of the first side wall and a second upper ledge portion on the first side wall aligned with the second lower foot structure, and wherein the first non-movable stacking structure further includes a first foot structure positioned a second distance from the front wall greater than the first distance on an outer lower portion of the second side wall and a first upper ledge portion on the second side wall aligned with the first foot structure of the second side wall and a second foot structure positioned the second distance from the back wall on the outer lower portion of the second side wall and a second upper ledge portion on the second side wall aligned with the second foot structure of the second side wall;

a non-moveable second stacking structure for stacking the tray with a like tray in a second orientation to provide a second clearance height for accommodating bakery items between the trays different than the first clearance height, wherein the second non-movable stacking structure includes a first upper ledge portion and a second upper ledge portion on the front wall and a first upper ledge portion and a second upper ledge portion on the back wall wherein the first upper ledge portion and the second upper ledge portion on the front wall and the first upper ledge portion and the second upper ledge portion on the back wall are lower than the first upper ledge portion and second upper ledge portion of the first side wall and the first upper ledge portion and second upper ledge portion of the second side wall; and, a non-moveable third stacking structure on the tray for stacking the tray with a like tray in a third orientation to provide a third clearance height for accommodating bakery items between the trays different than the first clearance height and the second clearance height, wherein each of the first side wall, second side wall, front wall and back wall of the top tray is directly supported on and aligned with one of the first side wall, second side wall, front wall, and back wall of the bottom tray in each of the first, second and third orientations.

2. The tray of claim 1 wherein the tray is formed from a molded plastic and the first, second and third stacking structures are integrally formed in the tray.

3. The tray of claim 1 wherein the third stacking structure includes a first lower ledge portion on the first side wall at the second distance from the front wall, and a second lower ledge portion at the second distance from the back wall, and a first lower ledge portion on the second side wall at the first distance from the front wall and a second lower ledge portion the first distance from the back wall, wherein the first and second lower ledge portion of the first side wall and the first and second lower ledge portions of the second side wall are lower than the first and second upper ledge portions of the front wall and the first and second upper ledge portions of the back wall.

4. The tray of claim 3 wherein the front wall includes a first guide structure extending from an outer lower portion of the front wall.

5. The tray of claim 4 the back wall includes a first guide structure extending from an outer lower portion of the back wall.

6. The tray of claim 1 wherein the first side wall and the second side wall each include a handle structure.

7. The tray of claim 1 wherein the first stacking structure is configured to require the tray to be stacked on the like tray with the first and second side walls, front wall and back wall of the tray being aligned with the first and second side walls, front wall and back wall, respectively, of the like tray.

8. The tray of claim 1 wherein the second stacking structure is configured to require the tray to be stacked on the like tray with a 90° rotation from an alignment of the first and second side walls, front wall and back wall of the tray with the first and second side walls, front wall and back wall, respectively, of the like tray.

9. The tray of claim 1 wherein the third stacking structure is configured to require the tray to be stacked on the like tray with a 180° rotation from an alignment of the first and second side walls, front wall and back wall of the tray with the first and second side walls, front wall and back wall, respectively, of the like tray.

10. The tray of claim 1 wherein the third stacking structure includes a first plurality of feet extending outward from the front wall and a second plurality of feet extending outward from the back wall.

11. The tray of claim 1 wherein the third stacking structure includes:

a first upper ledge portion of the front wall proximate a first side of the central lower wall portion, and a second upper ledge of the front wall proximate an a second side of the central lower wall portion.

12. The tray of claim 11 further comprising:

a first upper ledge portion on the back wall proximate the first side wall, and a second upper ledge portion on the back wall proximate the second side wall.

13. A tray for transporting items comprising:

a square bottom wall supporting a first side wall and a second side wall, a front wall and a back wall, the front wall having a central lower wall portion having a height less than a height of the first and second side walls for visible inspection of an interior of the tray;

a first bottom support structure and a first top structure, wherein the first bottom structure is configured to mate with the first top structure so that when the tray is stacked on a second like tray with the front wall of the tray aligned with and positioned over the front wall of the second tray, the two trays stack to a first height for accommodating bakery items having a first distance between the bottom wall and a bottom wall of the second tray, wherein the bottom support structure comprises a first foot structure positioned on a lower outer portion of the first side wall proximate the front wall, a second foot structure positioned on the lower outer portion of the first side wall proximate the back wall, a first foot structure positioned on a lower outer portion of the second side wall a first distance from the front wall, and a second foot structure positioned on the lower outer portion of the second side wall the first distance from the back wall, and wherein the first top structure comprises a first upper ledge portion at a first height above the bottom wall on the first side wall aligned with the first foot structure of the first side wall, a second upper ledge portion at the first height above the bottom wall on the first side wall aligned with the second foot structure of the first side wall, a first upper ledge portion on the second side wall at the first height above the bottom wall aligned with the first foot structure on the second side wall, and a second upper ledge portion on the second side wall at the first height above the bottom wall aligned with the second foot structure of the second side wall;

a second top structure, wherein the first bottom support structure is configured to mate with the second top structure so that when the tray is stacked on a second like tray with the front wall aligned with and positioned over one of the first and second side walls of the second tray, the two trays stack to a second height for accommodating bakery items having a second distance between the bottom wall and the bottom wall of the second tray that is different from the first height, wherein the second top structure comprises a first upper ledge portion on the front wall at a second height above the bottom wall lower than the first height positioned to support one of the first foot structure of the first side wall and the first foot structure of the second side wall of a like tray, a second upper ledge portion on the front wall at the second height above the bottom wall to support one of the second foot structure of the first side wall and the second foot structure of the second side wall of a like tray, a first upper ledge portion on the back wall at the second height above the bottom wall positioned to support one of the first foot structure of the first side wall and the first foot structure of the second side wall of a like tray, and a second upper ledge portion on the back wall at the second height above the bottom wall positioned to support one of the second foot structure of the first side wall and the second foot structure of the second side wall of a like tray; and, a third top structure, wherein the first bottom support structure is configured to mate with the third top structure when the tray is stacked on a second identical tray with the front wall of the first tray aligned with and positioned over the back wall of the second tray, the two trays stack to a third height for accommodating bakery items having a third distance between the bottom wall and the bottom wall of the second tray that is different than the first height and the second height, wherein each of the first side wall, second side wall, front wall and back wall of the top tray is directly supported on and aligned with one of the first side wall, second side wall, front wall, and back wall of the bottom tray in each of the first, second and third orientations, wherein the third top structure comprises a first lower ledge portion on the first side wall at a third height above the bottom wall lower than the second height positioned the first distance from the front wall, a second lower ledge portion on the first side wall at the third height above the bottom wall positioned the first distance from the back wall, a first lower ledge portion on the second side wall at the third height above the bottom wall positioned proximate the front wall, and a second lower ledge portion at the third height above the bottom wall proximate the back wall.

14. The tray of claim 13 further comprising a first center guide on the front wall and a first center guide on the back wall.

* * * * *